US010105557B1

(12) United States Patent
Yurechko et al.

(10) Patent No.: US 10,105,557 B1
(45) Date of Patent: Oct. 23, 2018

(54) VALVE/CONNECTION SYSTEM TO PREVENT DOWNSTREAM CONTAMINATION FROM AN UPSTREAM SOURCE WHILE REPLACING FILTERS

(71) Applicant: U.S. Army Edgewood Chemical and Biological Command, APG, MD (US)

(72) Inventors: Steven A Yurechko, Abingdon, MD (US); Douglas E. Wilke, Joppa, MD (US)

(73) Assignee: The United States of America as Represented by the Secretary of the Army, Washington, DC (US)

( * ) Notice: Subject to any disclaimer, the term of this patent is extended or adjusted under 35 U.S.C. 154(b) by 948 days.

(21) Appl. No.: 14/533,256

(22) Filed: Nov. 5, 2014

Related U.S. Application Data

(60) Provisional application No. 61/900,699, filed on Nov. 6, 2013.

(51) Int. Cl.
*A62B 18/10* (2006.01)
*A62B 9/04* (2006.01)
*A62B 23/02* (2006.01)

(52) U.S. Cl.
CPC ..... *A62B 18/10* (2013.01); *A62B 9/04* (2013.01); *A62B 23/02* (2013.01)

(58) Field of Classification Search
CPC ..... A62B 18/10; A62B 9/04; A62B 23/02
See application file for complete search history.

(56) References Cited

U.S. PATENT DOCUMENTS 4,549,543 A * 10/1985 Moon ..... A62B 18/025 128/206.12
4,793,342 A * 12/1988 Haber ..... A62B 9/04 128/202.27
4,932,399 A * 6/1990 Cappa ..... A62B 9/04 128/202.27
4,961,420 A * 10/1990 Cappa ..... A62B 18/02 128/201.19
5,782,235 A * 7/1998 Muller ..... A62B 9/04 128/202.27
6,467,481 B1 * 10/2002 Eswarappa ..... A62B 7/10 128/205.27
2004/0025880 A1 * 2/2004 Capon ..... A62B 9/04 128/206.15
2006/0283453 A1 * 12/2006 Haddad ..... A62B 23/02 128/205.29

* cited by examiner

*Primary Examiner* — Gregory Anderson
*Assistant Examiner* — Jonathan Paciorek
(74) *Attorney, Agent, or Firm* — Ulysses John Biffoni

(57) ABSTRACT

The present invention provides an improved filter connection system for a gas mask, comprising: a filter, a mounting means that attaches the filter to the gas mask, and a retainer means to hold the filter within the mounting means. The mounting means includes a protruding means; a valving assembly in communication with the protruding means, wherein the valving assembly enables air to flow from the fitter to the mask when the retainer means retains the protruding means, and disables air flow from the filter to the mask when the protruding means disengages from the retainer means; and a sealing means located within or adjacent to the valving assembly to prevent air from outside of the filter from entering the mounting means.

10 Claims, 14 Drawing Sheets

VALVE/CONNECTION SYSTEM TO PREVENT DOWNSTREAM CONTAMINATION FROM AN UPSTREAM SOURCE WHILE REPLACING FILTERS

CROSS REFERENCE TO RELATED APPLICATION

This application claims the benefit of U.S. Provisional Patent Application Ser. No. 61/900,699 filed on Nov. 6, 2013, the content of which is incorporated by reference in its entirety.

GOVERNMENT INTEREST

The invention described herein may be manufactured, used, and/or licensed by or for the United States Government.

FIELD OF THE INVENTION

This invention relates to an improved filter connection system for a respirator or gas mask to prevent contamination from an upstream source.

BACKGROUND OF THE INVENTION

Respirators are commonly worn over the breathing passages of a person to prevent impurities or contaminants from entering the wearer's respiratory tract.

A variety of respirators have been designed to meet this purpose. Some military respirators have been categorized as Joint Service General Purpose Masks ("JSGPM's"), for which filters will need to be periodically replaced to remain useful.

The effectiveness of JSGPM has been evaluated by comparing the amount of corn oil aerosol in a test chamber to that inside the mask while the test subject performs various exercises designed to stress the seal of the mask while wearing the mask in the chamber. Higher protection factor values assigned to the mask indicate that the user is getting a good seal and there is little or no contamination inside the mask.

Some of these aerosol tests were conducted as filter exchange tests to ensure that a user can switch out filters in a contaminated environment. During these trials, a user removes a filter on one side of the mask, relaxes for one minute to ensure that a seal is maintained, and then replaces the filter. The test results are evaluated on whether the protection factor value during the filter removal exercise goes below a certain threshold. The JSGPM performs well in this regard. However, when the filter is replaced on the mask, the contamination that is trapped in the cavities between the JSGPM filter mount and the filter canister itself can be pushed up into the mask by air pressure. This air movement reduces the Protection Factor of the mask from anywhere between 50-100 PF, which indicates that for several seconds the user is breathing a large amount of contamination from outside of the mask. While it is not hazardous to breathe in corn oil during a filter replacement test, in a real contaminated environment such a contamination spike would be enough to incapacitate or even kill a user based on the chemical or biological agent that was inhaled. This concern deters an individual user in the field from replacing filters in a contaminated environment, and users must exit the area of contamination to replace fitters and then re-enter the contaminated location to continue the mission, which greatly reduces the mission effectiveness.

A new filter connection system is being provided herein to address this issue. Various designs of the filter connection system will focus on removing the air cavities between the filter mount and filter canister, so that when users replace a filter while wearing a mask in a contaminated environment, the spike of contamination can be eliminated or greatly reduced.

SUMMARY OF THE INVENTION

The present invention provides an improved filter connection system for a gas mask, comprising a filter, a mounting means that attaches the filter to the gas mask, and a retainer means to hold the filter within the mounting means, the mounting means comprising: 1) a protruding means; 2) a valving assembly in communication with the protruding means, wherein the valving assembly enables air to flow from the filter to the gas mask when the retainer means retains the protruding means, and disables the air flow when the protruding means disengages from the retainer means; and 3) a sealing means located within or adjacent to the valving assembly to prevent air from outside of the filter entering the mounting means. The filter connection system allows minimal trapped air to exist in the mounting means during the replacement of the filter, so as to reduce the amount of contaminated air retained and breathed into the mask by the user during the filter replacement process. This filter connection system allows the user to replace the used filter in a field or contaminated environment.

BRIEF DESCRIPTION OF THE DRAWINGS

The invention, together with the other objects, features, aspects and advantages thereof will be more clearly understood from the following in conjunction with the accompanying drawings.

DETAILED DESCRIPTION

The present invention provides an improved filter connection system for a gas mask, such that when the filter is being replaced or installed, the trapped air within the filter mount and the filter is minimized or eliminated, to prevent any contaminants carried within the trapped air to be pushed into the gas mask by air pressure.

The present invention provides an improved filter connection system for a gas mask, comprising a filter, a mounting means that attaches the filter to the gas mask, and a retainer means to hold the filter within the mounting means, the mounting means comprising: 1) a protruding means; 2) a valving assembly in communication with the protruding means, wherein the valving assembly enables air to flow from the filter to the gas mask when the retainer means retains the protruding means, and disables the air flow when the protruding means disengages from the filter means; and 3) a sealing means located within or adjacent to the valving assembly to prevent air from outside of the filter entering the mounting means. The filter retainer means further includes an opening to fully and tightly receive the protruding means, such that the retainer means engages and shifts the protruding means to trigger the valving assembly to enable air to flow from the filter, through the mounting means to the breathing path within the gas mask. A membrane or film seals the opening, so to ensure that no contaminant enters the filter, prior to the retaining means receiving the protruding means. The sealing means insulates the air flow path and prevents contaminated air from being drawn into the filter connection system. When a user replaces the filter, the user disengages the filter connection system from the mounting means. The replacement releases the protruding means from the retainer opening, such that the valving assembly encloses and secures the protruding means to seal off the air flow path, preventing the user from breathing in contaminated air.

The filter is selected from the materials consisting of high efficiency particulate air ("HEPA") filters, activated carbon filters, pleated paper-type filters, and mixtures thereof.

Figure 1:
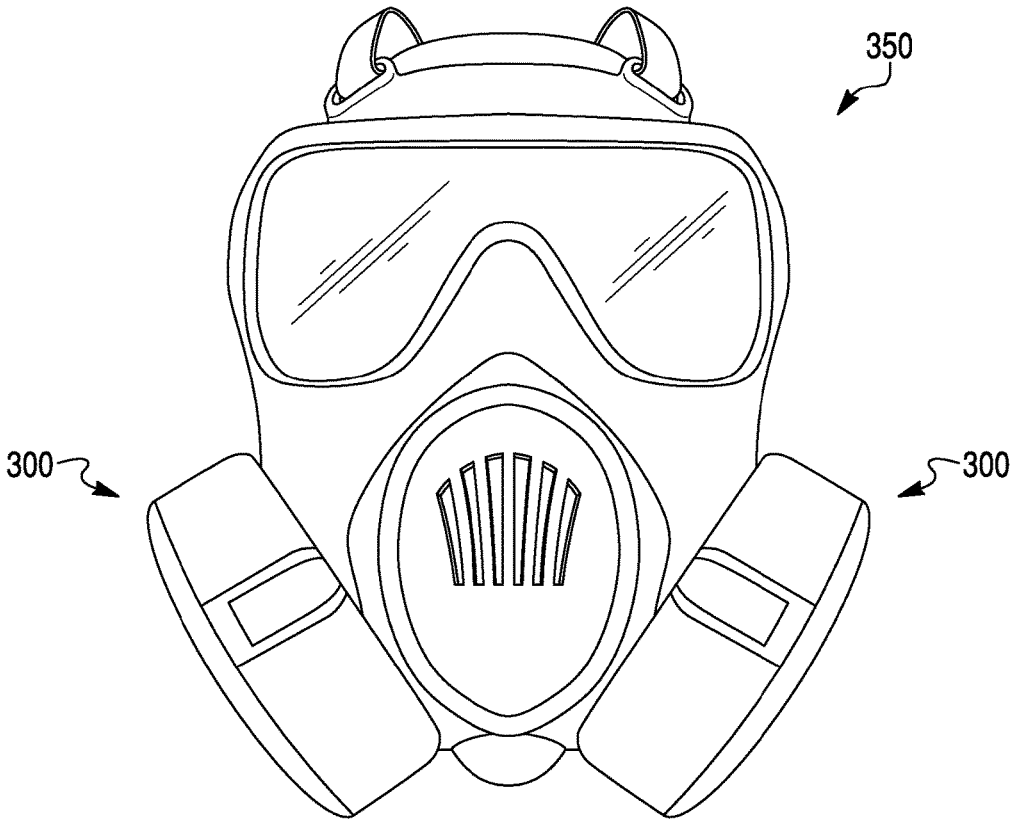
FIG. 1 depicts a filter mounted onto a gas mask.
Figure 2:
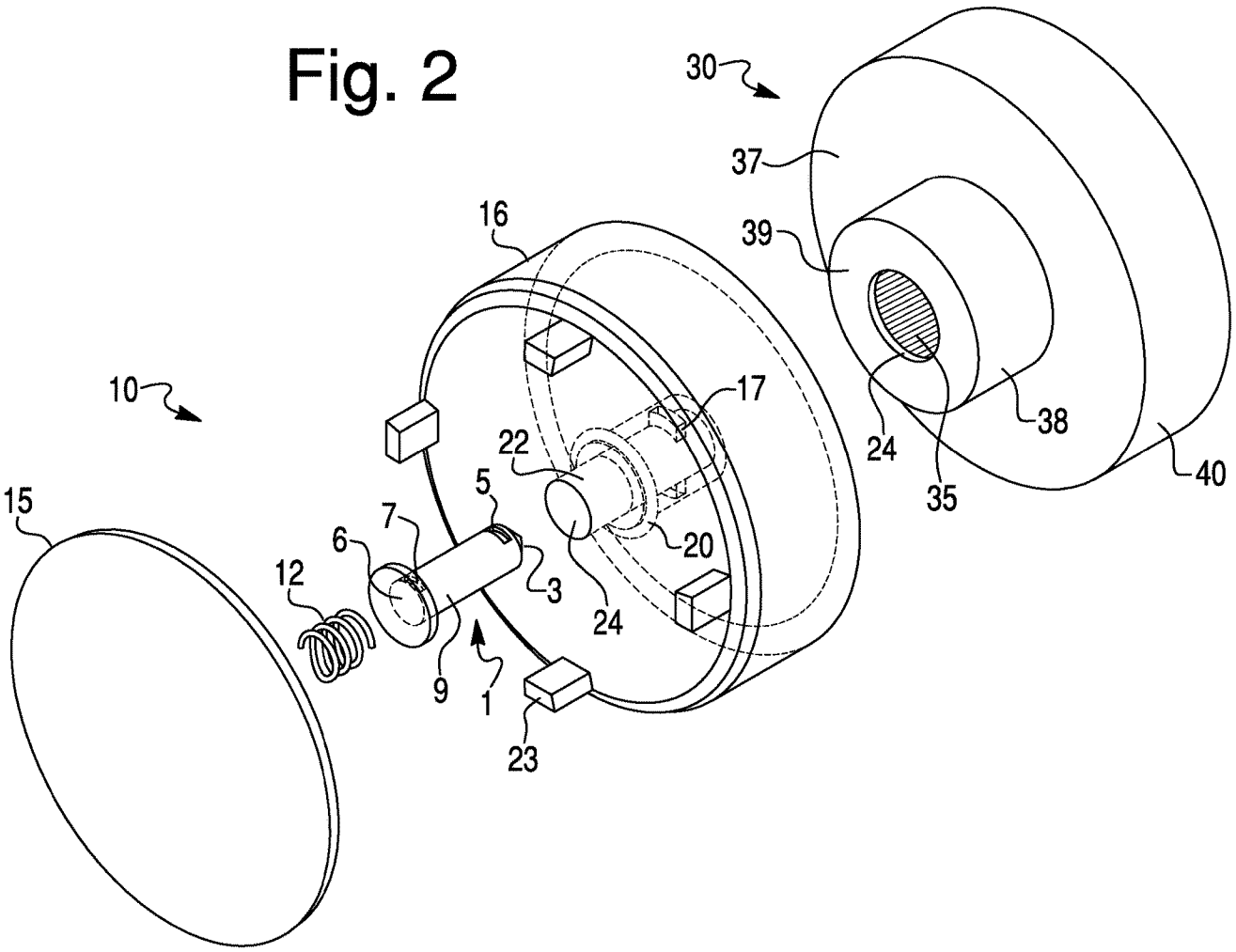
FIG. 2 depicts an exploded view of the assembled filter connection system.

Several embodiments of the filter connection system are shown. Generally, each filter connection system 300 is fitted onto either side of the gas mask 350 as shown in FIG. 1. In FIG. 2, a filter connection system comprises a filter 40, a mounting means 10 that attaches filter 40 to a gas mask, and a retainer means 38, which holds the filter 40 to mounting means 10. Mounting means 10 is comprised of a protruding means 1, and a valving assembly that is comprised of a back plate 15, a tension means 12, and a cover 16 that further includes supports 23 and a tubing 22 that has an inlet 17. Briefly, tension means 12 is located at the center of back plate 15 and attached to an end 6 of protruding means 1 and anchors protruding means 1 within tubing 22 of cover 16, such that inlet 17 is linearly located between an inlet 5 and an outlet 7 of protruding means 1. Supports 23 connect and secure back plate 15 onto cover 16, such that the valving assembly encloses protruding means 1 to form mounting means 10.

Figure 3B:
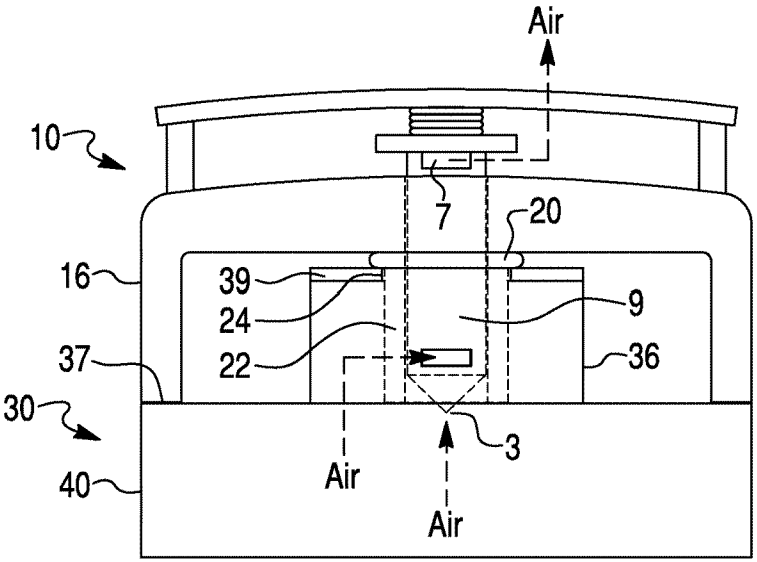
FIG. 3B depicts a cross-sectional view of the filter connection system in an engaged state.
Figure 3A:
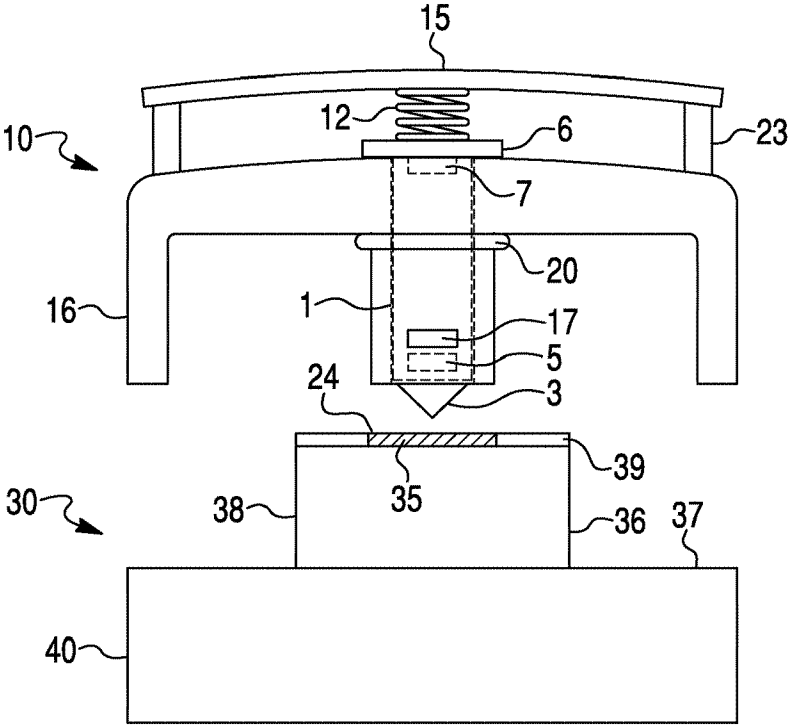
FIG. 3A depicts a cross-sectional view of the filter connection system in an idle-state.

As shown in FIG. 3A, in an "idle-state", inlet 17 is not aligned with outlet 5, thus, inlet 5 and outlet 7 are closed to block off air from outside of mounting means 10, while retainer means 38 connects to filter 40, and has an opening 24 that is blocked by membrane 35, so that no air flows into filter 40. The assembly of filter 40 and retainer means 38 is a filter means 30.

As shown in FIG. 3B, in an "engaged state", placement of a new filtering means 30 onto mounting means 10 causes a tip 3 of protruding means 1 to puncture through filter membrane 35 located within opening 24 of retainer means 38, such that tubing 22 fits tightly through opening 24. Cover 16 closes onto filter surface 37, and a sealing means 20 seals the gap between mounting means 10 and a platform 39 of retainer means 38. At this point, filter 40 stops and pushes tip 3 upward, thereby shifting protruding means 1 to align inlet 17 with inlet 5 and to open outlet 7, so that air flows from filter 40 into a compartment 36 and inlet 17, through a tubing 9 of protruding means 1 and exits outlet 7 into the breathing path of the mask.

Since there is no outside air present from the time tip 3 of protruding means 1 punctures through membrane 35, and since opening 24 is only slightly larger than tubing 22, there is minimal if any contamination that enters into the mask. Further, sealing means 20 is the primary seal between mounting means 10 and filter means 30 in an engaged state. The air flow will create a negative air pressure gradient with filter means 30. Mounting means 10 with cover 16 will provide a good seal to prevent contamination from entering the space.

Figure 4:
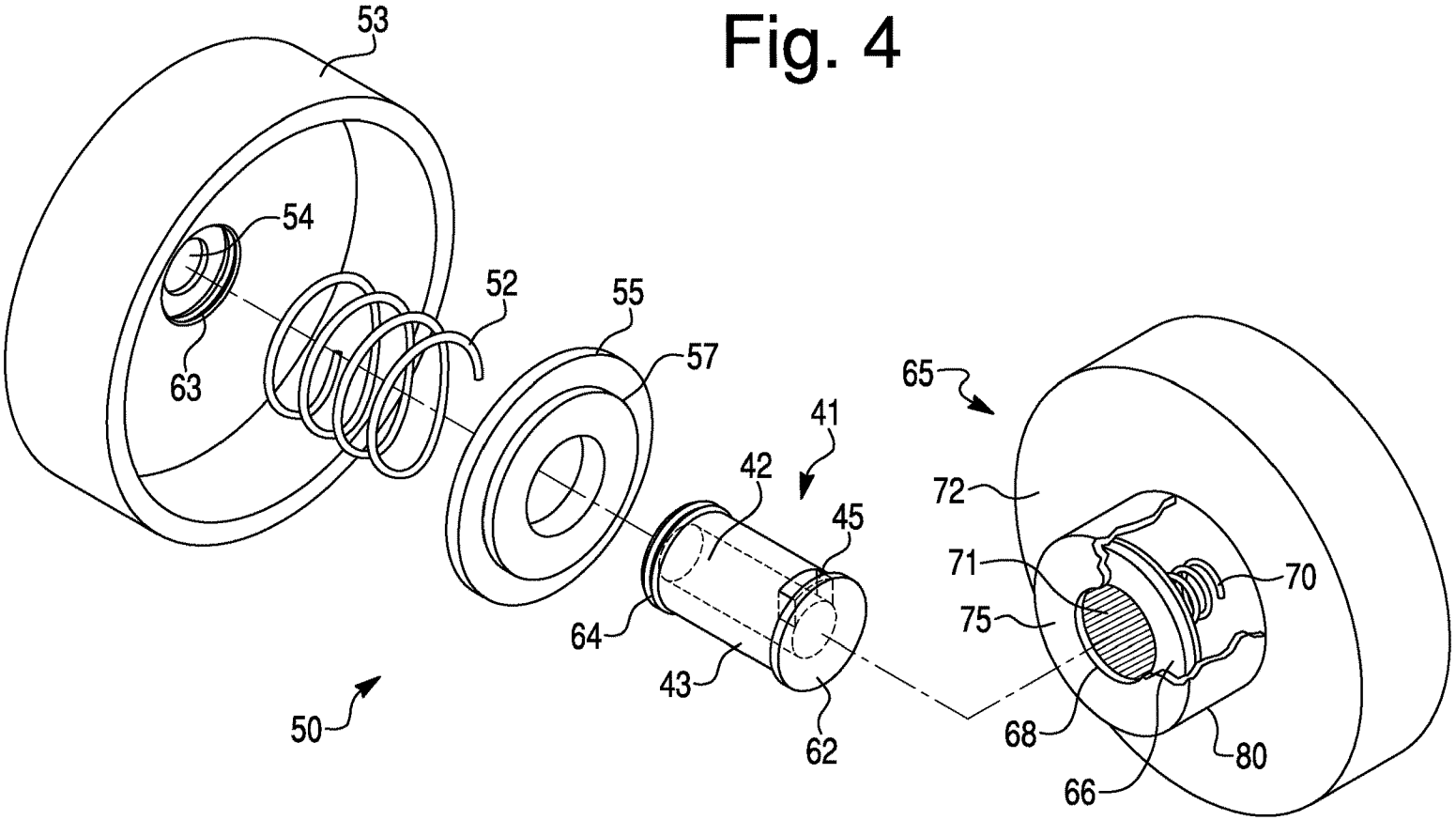
FIG. 4 depicts an alternative view of the assembled filter connection system.

Alternatively, another embodiment is shown in FIG. 4, wherein a mounting means 50 includes a protruding means 41, and a valving assembly that is comprised of a cover 53, a tension means 52, an opening 54, a disk 55, and a sealing means 57. Briefly, protruding means 41 fits through disk 55 and sealing means 57, such that disk 55 is adjacent and above sealing means 57, and sealing means 57 is adjacent and above end 62. Tension means 52 encloses protruding means 41 exposing a threaded end 64 that matches and attaches to a threaded opening 63 of cover 53, to establish an open channel from tubing 42 of protruding means 41 to opening 54.

Figure 5B:
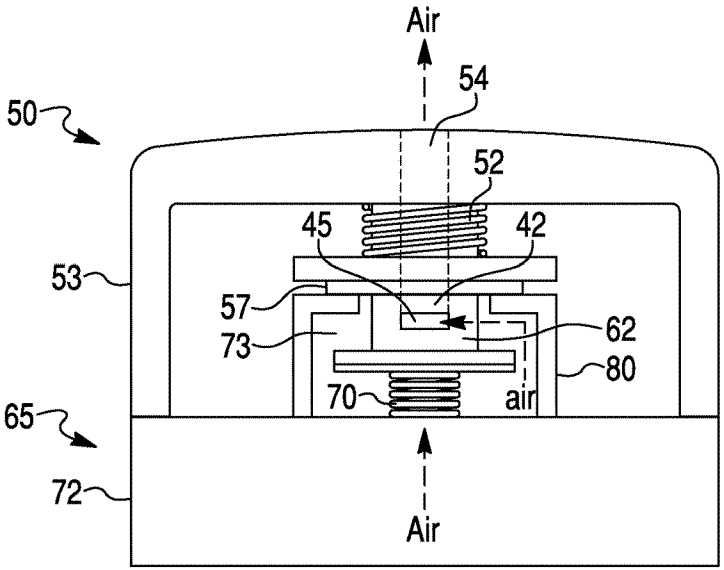
FIG. 5B depicts a cross-sectional view of the filter connection system in an engaged state.
Figure 5A:
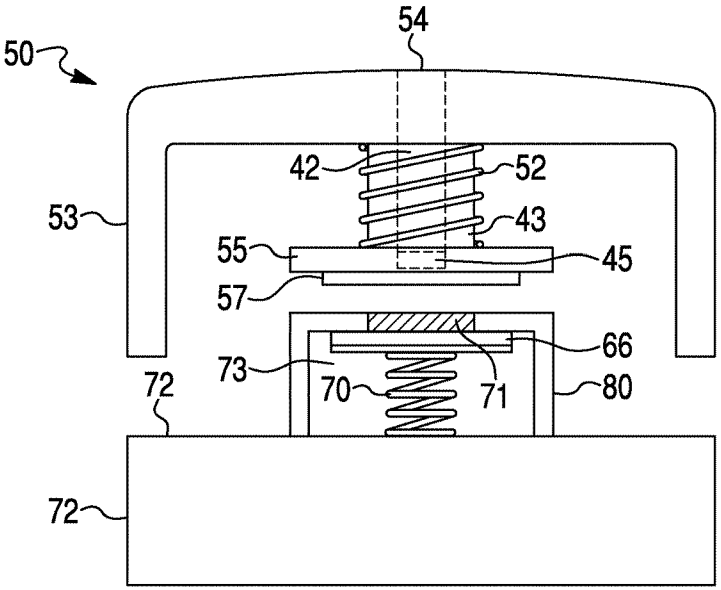
FIG. 5A depicts a cross-sectional view of the filter connection system in an idle-state.

As shown in FIG. 5A, in an "idle-state", disk 55 blocks inlet 45 to seal off any air flow from outside of mounting means 50. A filter 72 is attached to a retainer means 80 to form a filter means 65, and has an opening 68 that is covered by a membrane 71. A tension means 70 within retainer 80 pushes up a platform 66, such that platform 66 is underneath membrane 71 and flushed against opening 68 to prevent contaminated air from entering filtering means 65.

As shown in FIG. 5B, in an "engaged state", placement of filtering means 65 causes a base 62 of protruding means 41 to break through membrane 71, and to push down platform 66 located within retainer means 80, which is adjacent and above filter 72. At this point, cover 53 of the mounting means 50 comes in direct contact with filter 72, compresses tension means 52 and 70, such that inlet 45 is exposed to a compartment 73 within retainer 80, so that air flows from filter base 72 into compartment 73 and inlet 45, through tubing 42 of protruding means 41 and exits out opening 54 into breathing path of the mask. Sealing means 57, in the form of an o-ring, seals the gap between mounting means 50 and retainer means 80 to prevent contaminated air from entering.

Figure 6:
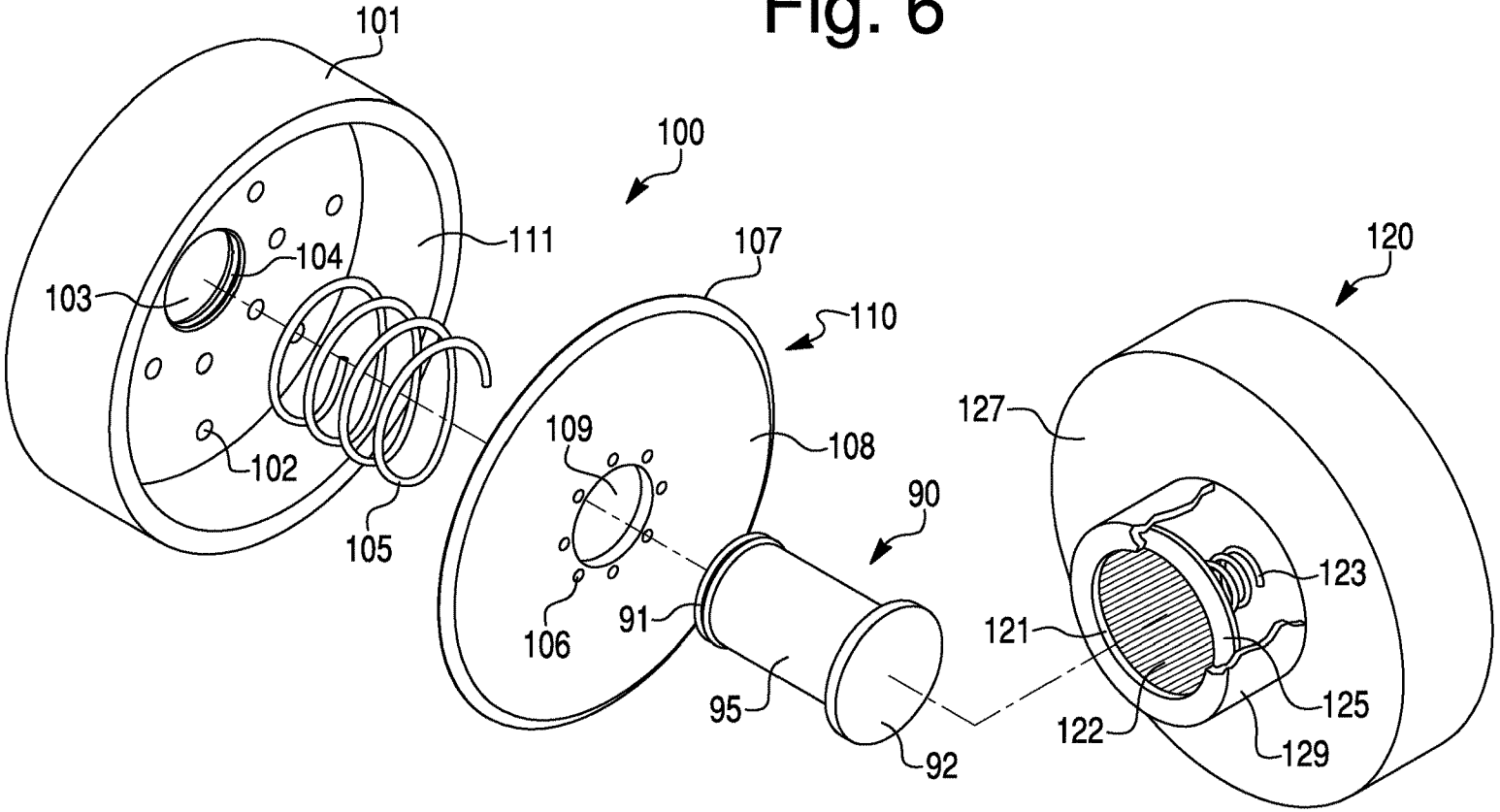
FIG. 6 depicts an alternative view of the assembled filter connection system.

Alternatively, another embodiment of the filter connection system is shown in FIG. 6, wherein the filter connection system comprises a mounting means 100 that includes a solid protruding means 90, and a valving system that includes a cover 101 that has an opening 103, an air holes 102, a tension means 105, and a disk 110 comprises a sealing means 107 on its outer circumference, a central opening 109 and air holes 106 surround opening 109.

Figure 7B:
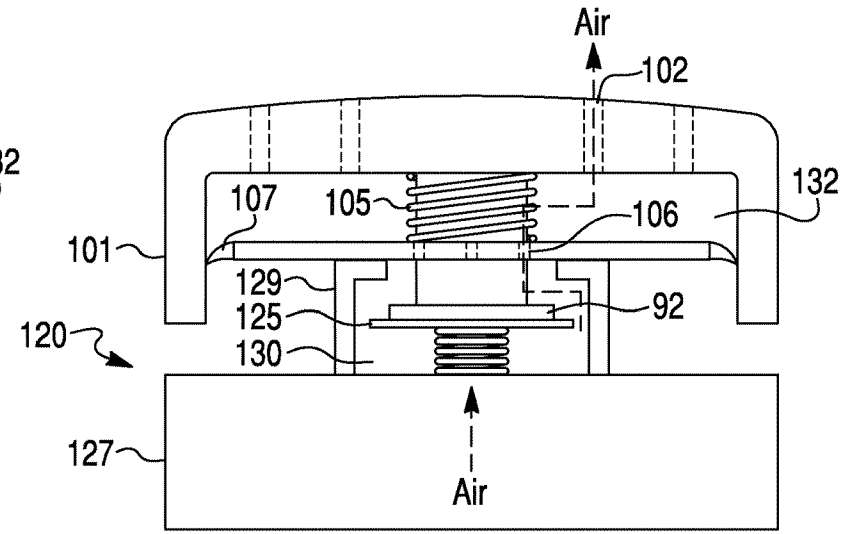
FIG. 7B depicts a cross-sectional view of the filter connection system in an engaged state.
Figure 7A:
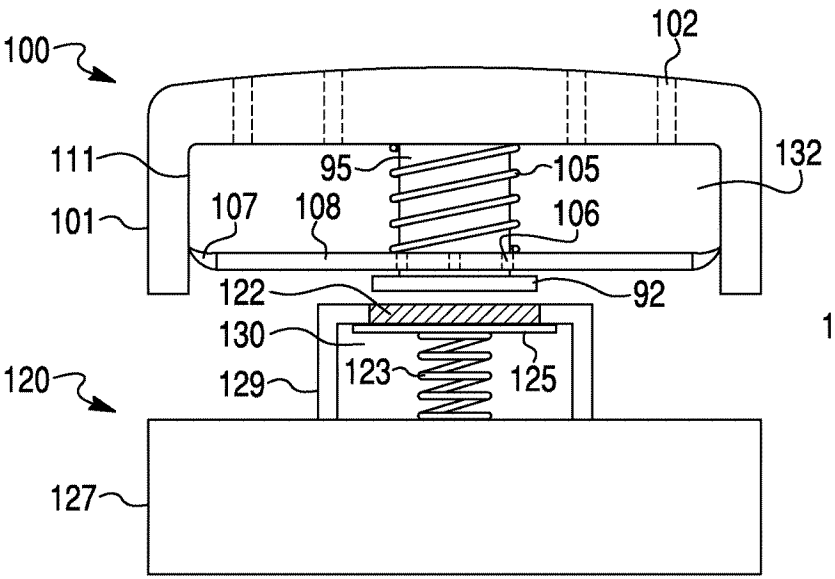
FIG. 7A depicts a cross-sectional view of the filter connection system in an idle-state.

As shown in FIGS. 6 and 7A, in an "idle-state", a column 95 of protruding means 90 fits through central opening 109, wraps by tension means 105 and anchors to opening 103 through a threaded end 91 that engages threads 104 of cover 101. Accordingly, the valving system encloses protruding means 90 to form mounting means 100. Further, a base 92 of protruding means 90 in the form of a gasket, is wide enough to cover air holes 106, and sealing means 107 is flushed against the inner wall 111 to cover 101. At this point, base 92 and sealing means 107 effectively block air flow from outside of mounting means 100. Meanwhile, a retainer means 129 contains an opening 121, which is covered by a membrane 122. Retainer means 129 further includes a tension means 123 that pushes up a platform 125, to further block opening 68, underneath membrane 122, to prevent contaminated air from entering filter 127. An assembly of retainer means 129 and filter 127 is a filtering means 120.

As shown in FIG. 7B, in an "engaged-state", placement of filtering means 120 causes base 92 of protruding means 90 to break through membrane 122 and to push down platform 125 of retainer means 129, which is adjacent and above filter 127. At this point, cover 101 of the mounting means 100 comes in direct contact with filter 127, compresses tension means 105 and 123 and pushes down protruding means 90 into a compartment 130 to expose air holes 106, such that air flows from filter base 127 into a compartment 130, through air holes 106 into compartment 132 then exits air holes 102 into breathing path of the gas mask. Sealing means 107, in the form of a rubber ring surrounding disk 110, seals the gap between mounting means 100 and retainer means 129 to prevent contaminated air from entering.

Figure 8:
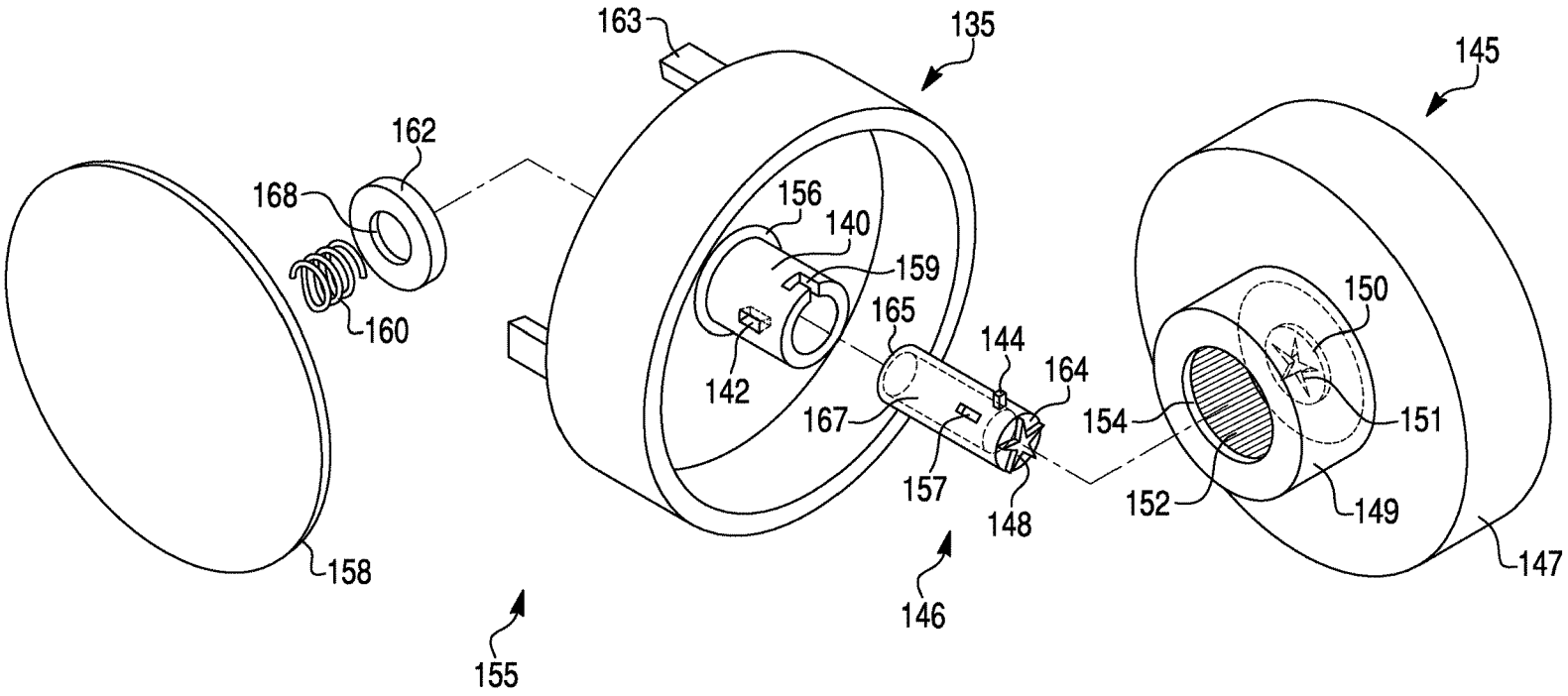
FIG. 8 depicts an alternative view of the assembled filter connection system.

Alternatively, another embodiment of the filter connection system is shown in FIG. 8, wherein the filter connection system comprises a mounting means 155, 1) a hollow protruding means 146 that includes inlet 157, a knob 144, and a male portion 168 on one end 164; and 2) a valving system that includes a back plate 158, a tension means 160, an anchor disk 162, and a cover 135 that further includes a tubing 140 with an inlet 142 and an anchoring groove 159.

Figure 9B:
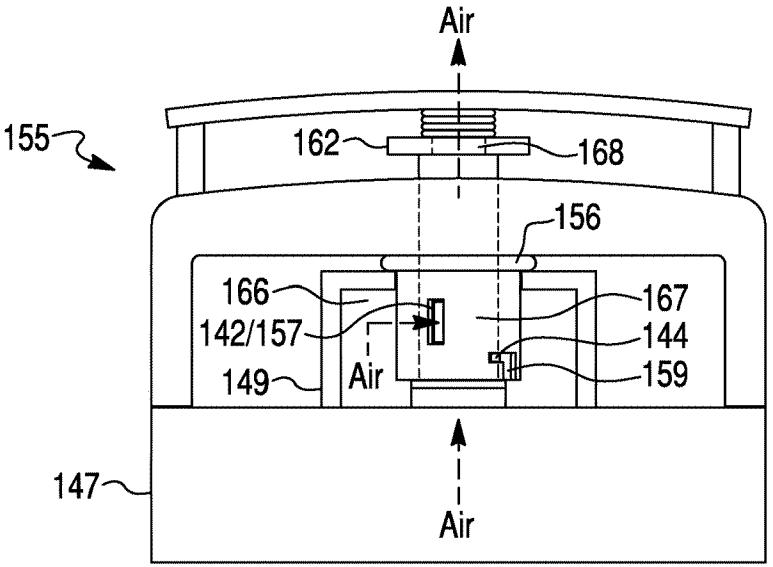
FIG. 9B depicts a cross-sectional view of the filter connection system in an engaged state.
Figure 9A:
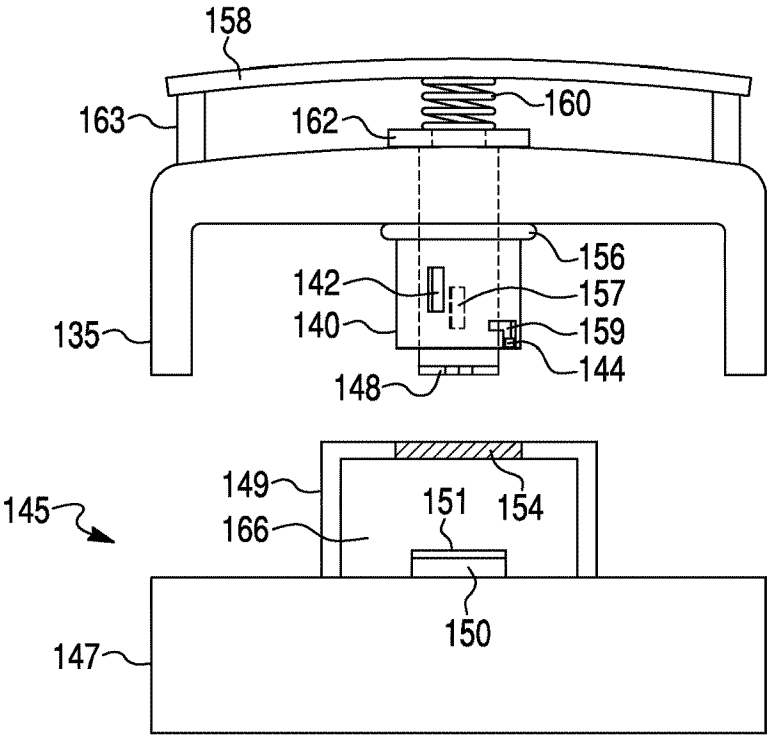
FIG. 9A depicts a cross-sectional view of the filter connection system in an idle-state.

As shown in FIG. 8 and FIG. 9A, in an "idle-state", an end 165 of protruding means 90 is engaged to anchor disk 162 and attached through threaded opening 168, which is attached to tension means 160. Back plate 158 pushes down tension means 160. A second end 164 of protruding means 146 then fits through tubing 140, and cover 135 is twisted such that knob 144 on protruding means 146 slide onto anchoring groove 159, and inlet 157 is parallel to inlet 142, but blocked by the tubing wall of 140. At this point, back plate 158 is attached to cover 135 via stands 163 and holds tension means 160 in place to provide tension/pressure onto anchor disk 162. Overall, the valving system encloses protruding means 146 to form mounting means 155. Meanwhile, filtering means 145 is comprised of a filter 147 and a retainer means 149 that includes an opening 154 that is covered by a membrane 152, which prevents contaminated air from entering filter means 145. Within the retainer means there is a matching platform 150 containing a female pattern 151 that matches with male pattern 148 of protruding means 146.

As shown in FIG. 9B, in an "engaged-state", placement of filtering means 145 causes protruding means 146 to break through membrane 152, and male part 148 matches female part 151. The matching anchors protruding means 146 to filter 147. Sealing means 156 seals the gap between retainer means 149 and mounting means 155. Thereafter, filter 147 is twisted to shift knobs 144 deeper into and anchors by anchoring groove 159, causing inlets 157 and 142 to align, such that air flows from filter 147 into a compartment 166, entering inlets 142 and 157 into tubing 167 and exits opening 168 on disk 162 into breathing path of the gas mask.

Figure 10:
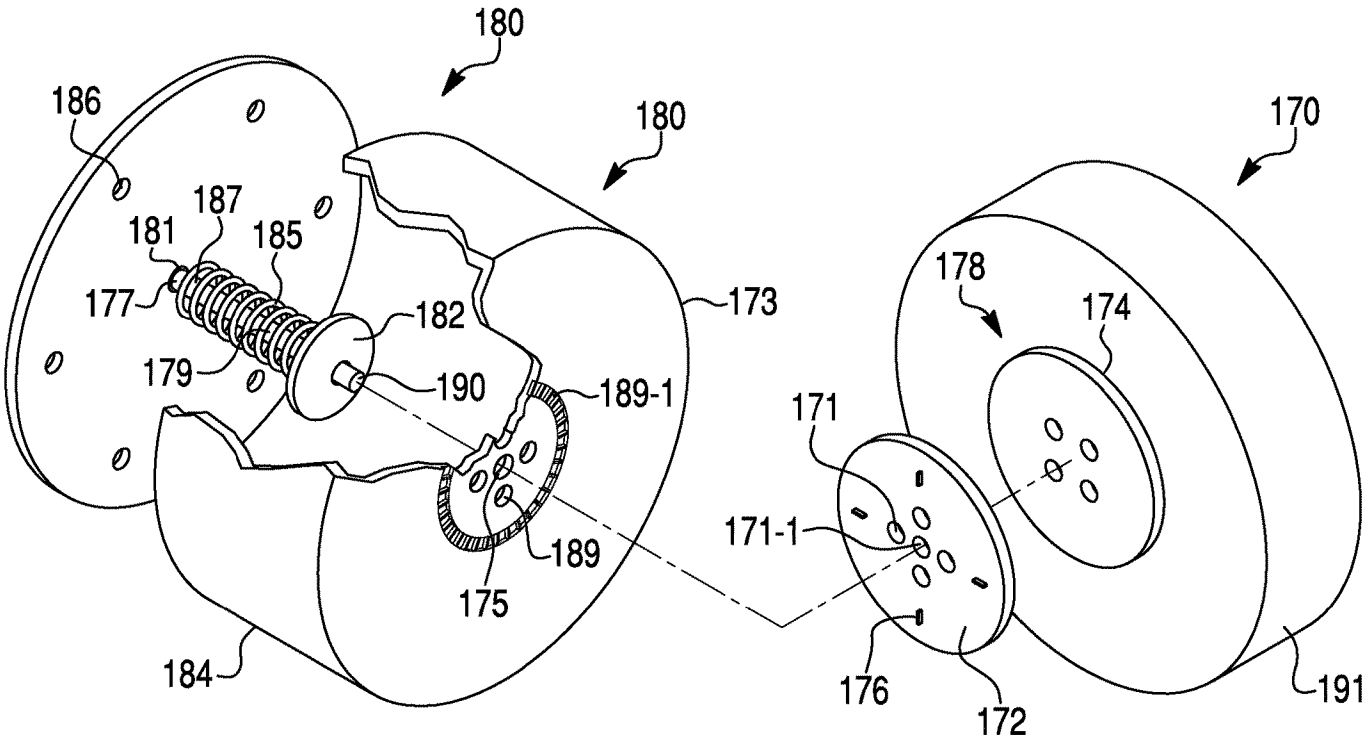
FIG. 10 depicts an alternative view of the assembled filter connection system.
Figure 11B:
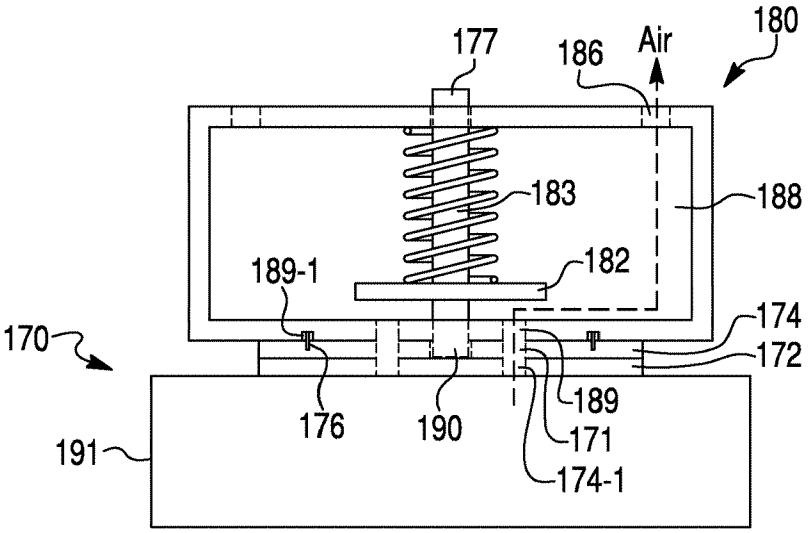
FIG. 11B depicts a cross-sectional view of the filter connection system in an engaged state.
Figure 11A:
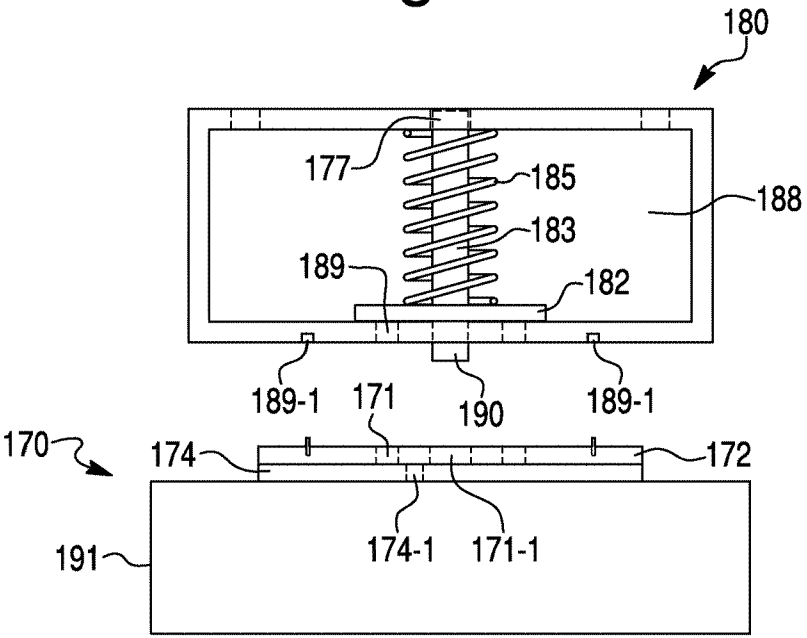
FIG. 11A depicts a cross-sectional view of the filter connection system in an idle-state.

Another embodiment of the filter connection system is shown in FIGS. 10 and 11A, wherein the filter connection system comprises 1) a filter means 170 that includes a filter 191 and a retainer means 178 having a disk 172 and 174; and 2) a mounting means 180, wherein mounting means 180 is comprised of a protruding means 179 enclosed within a valving system that includes a tension means 185, a sealing means 182, a housing 184, and a cover 173 that has a center hole 175, inlets 189 surrounding hole 175 and track 189-1 surrounding the inlets 189. In an "idle-state", a tension means 185 wraps a column 187 of protruding means 179, exposing an end 177, which then fits through an exit hole 181 of housing 184, and the other end 190 of protruding means 179 fits through sealing means 182 and holding hole 175 centrally located in cover 173. Cover 173 then closes onto housing 184, exposing ends 177 and 190 to form mounting means 180. Sealing means 182, in the form of a washer gasket, securely covers inlets 189 to block contaminated air from entering mounting means 180. Meanwhile, retainer means 178, including disk 172 that has bulges 176 latchable to track 189-1, and is adjacent and rotatable relative to disk 174, wherein disk 172 has holes 171 surrounding anchoring hole 171-1, and disk 174 has holes 174-1 that matches holes 171 when disks 172 and 174 are in "open" positions. In idle-state, the disks 172 and 174 are in a "lock" position, so that disk 174 covers holes 171 on disk 172, to block contaminated air from entering filtering means 170.

As shown in FIG. 11B, in an "engaged state", placement of filtering means 170 onto mounting means 180 causes end 190 of protruding means 179 to fit tightly into anchoring hole 171-1, through disk 172 but stops at disk 174, such that bulges 176 latch onto track 189-1 and disk 174 pushes end 190 upward, lifting up sealing means 182 to reveal inlets 189, which are now aligned with holes 171. Filter means 170 is then twisted to rotate disk 172, such that holes 171, 189 and 174-1 are all aligned to allow air flow from filtering 191 into a compartment 188 and exits out holes 186 into breathing path of the gas mask.

Figure 12:
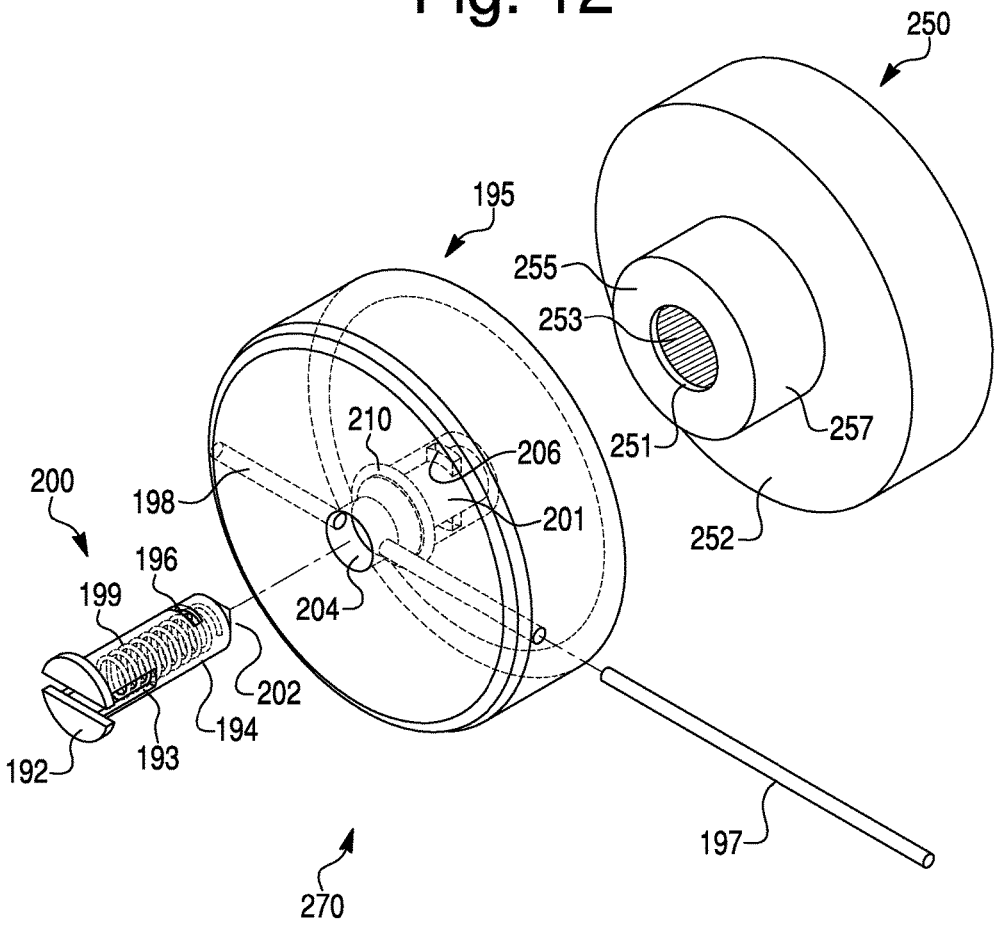
FIG. 12 depicts an alternative view of the assembled filter connection system.
Figure 13B:
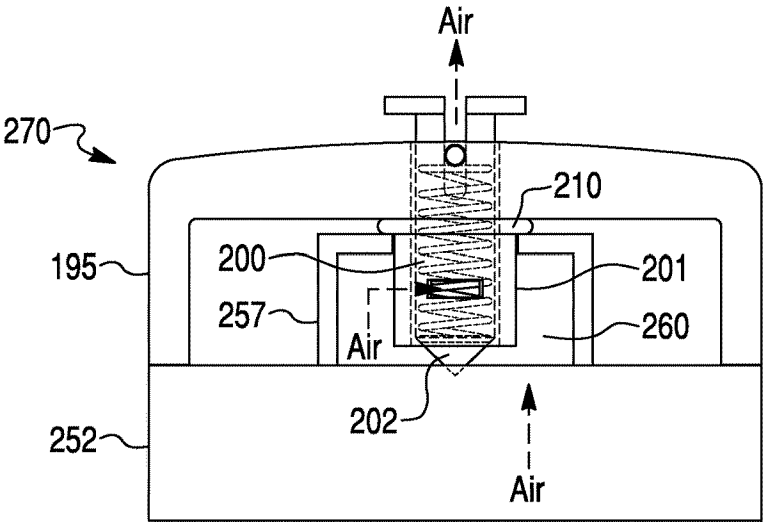
FIG. 13B depicts a cross-sectional view of the filter connection system in an engaged state.
Figure 13A:
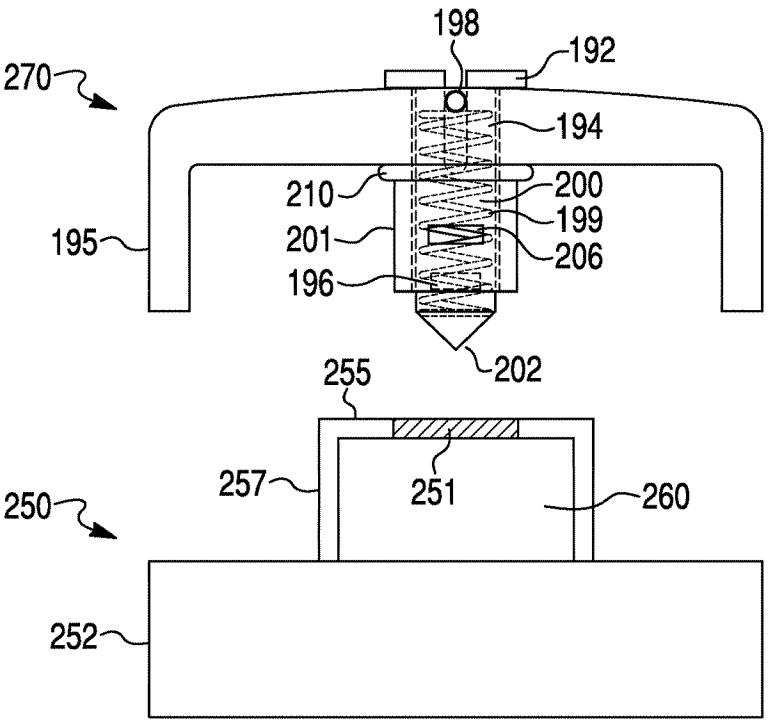
FIG. 13A depicts a cross-sectional view of the filter connection system in an idle-state.

Another embodiment of the filter connection system is shown in FIGS. 12 and 13A, comprising 1) a filter means 250 that includes a retainer means 257 and a filter base 252; and 2) a mounting means 270 that is comprised of a hollow protruding means 200 enclosed within a valving system that includes a tension means 199, a rod 197 and a cover 195. In an "idle-state", protruding means 200 contains tension means 199 and is inserted into an opening 204 of cover 195, then settles into a tubing 201, leaving a top 192 exposed above cover 195, and a tip 202 exposed outside of tubing 201, opposite to top 192. At this point, a groove 193 of protruding means 200 aligns with a channel 198 in cover 195, and rod 197 inserts into channel 198 through groove 193, such that rod 197 is adjacent and above tension means 199 to enclose protruding means 200 within cover 195 to form mounting means 270. At this point, an inlet 196 of protruding means 200 is parallel and below an inlet 206 of tubing 201, such that the tubing wall of 201 blocks inlet 196 to prevent contaminated air from entering mounting means 270. For filtering means 250, a membrane 253 covers an opening 251 of retainer means 252 to prevent contaminated air from entering filter 252.

As shown in FIG. 13B, in an "engaged state", placement of filtering means 250 onto mounting means 270 causes tip 202 to break through membrane 253, slides tubing 201 into compartment 260 and is stopped by filter 252. At this point, cover 195 is in contact with filter 252, and a sealing means 210 seals the gap between retainer 257 and cover 195 to prevent contaminated air from entering the filter connection system. As filter 252 stops tip 202 from advancing further, protruding means 200 is being pushed backwards within tubing 201 in the direction of rod 197, such that tension means 199 is compressed to align inlet 196 with inlet 206, so that air flows from filter 252 into compartment 260, through the aligned inlets, and exits from inner tubing 194 of protruding means 200 into breathing path of the gas mask.

EXAMPLE

Figure 14A:
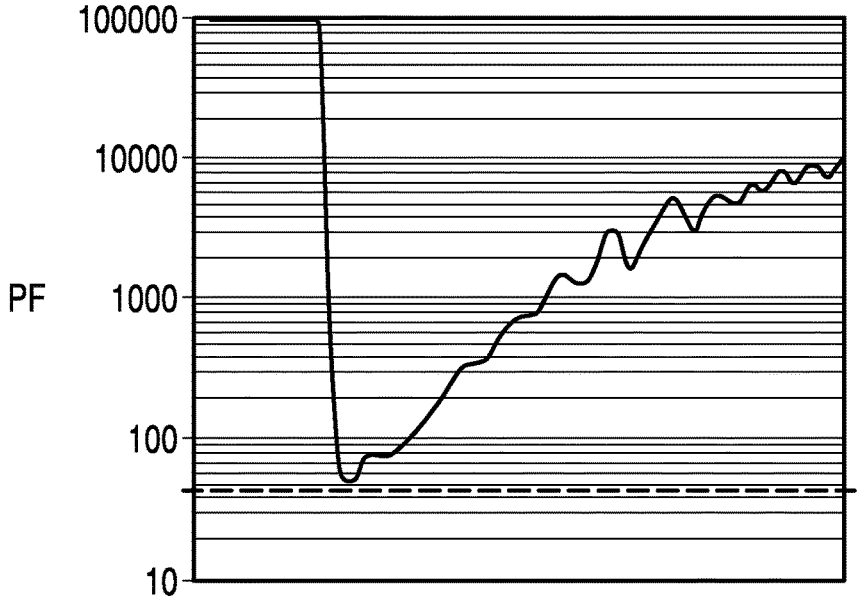
FIG. 14A depicts leak test results from a conventional filter connection system.
Figure 14B:
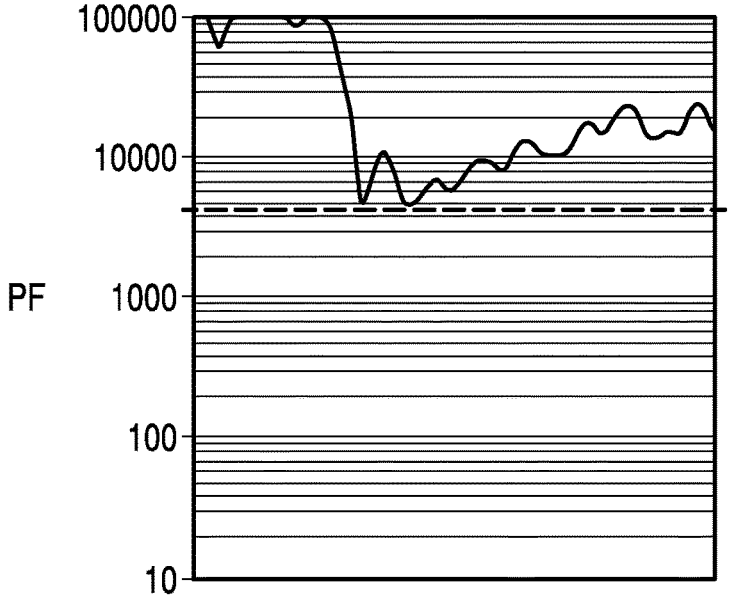
FIG. 14B depicts leak test results from an improved filter connection system.

A comparative test was conducted on an existing connection system on JSGPM versus an improved filter connection system. Corn oil aerosol was sprayed in a test chamber and a user in the chamber removes a filter from one side of the gas mask, releases for one minute to ensure that a seal is maintained, and then replaces the filter. A measurement of the leak proof aspect was done in Protection Factor when the filter is replaced on the mask. As shown in FIG. 14A, contamination spiked when the existing connection system was used and its corresponding filter was replaced in a tested environment, wherein the Protection Factor dropped to 50 PF from about 100,000 PF, or about 2.00% leak penetration, meaning that for several seconds, the users was breathing a large amount of contaminants from outside of the mask. Meanwhile, for the improved filter connection as shown in FIG. 14B, the Protection Factor only dropped to 4,000 PF from 100,000 PF, or about 0.025% leak protection, a drastic reduction from the existing connection system and an improvement which enables a user to change gas mask filters while in a contaminated field environment.

The invention claimed is:

1. A filter connection system, comprising: a filter, a mounting means that attaches said filter to a gas mask, and a retainer means to hold said filter within said mounting means, said mounting means including protruding means and a valving assembly in communication with said protruding means, wherein when said protruding means engages said retainer means said valving assembly enables air to flow from said filter to said gas mask, and disables air flow from said filter to said gas mask when said protruding means is disengaged from said retainer means, and wherein no outside air is entrapped between said protruding means and said retainer means when said protruding means engages said retainer means and said valving assembly enables air to flow from said filter to said gas mask; wherein said retainer means further includes an opening that receives said valving system, protruding means or both; wherein said opening contains a membrane that blocks air from entering said filter, and said protruding means breaks said membrane upon engaging said retainer means.

2. The filter connection system of claim 1, wherein said mounting means further includes a sealing means located within or adjacent to said valving assembly to provide an airtight seal between said mounting means and said retainer means.

3. The filter connection system of claim 2, wherein said sealing means is in the form of a gasket material made from a material selected from butyl or nitrile rubber.

4. The filter connection system of claim 1, wherein said protruding means is hollow and contains at least one inlet that upon engaging said retainer means allows air to flow from said filter into said valving assembly.

5. The filter connection system of claim 1, wherein said valving assembly includes a tension means that anchors the protruding means within said valving assembly prior to said protruding means engaging said retaining means, and after said engaging said tension means compresses to allow said protruding means to shift within said valving assembly to enable air to flow from said filter to said mounting means.

6. The filter connection system of claim 1, wherein said retainer means further includes a platform, wherein said platform blocks said opening prior to said protruding means engaging said retainer means, and said protruding means pushes down said platform to expose air from said filter base to said protruding means.

7. The filter connection system of claim 1, wherein said retainer means has a female portion, and said protruding means contains a male portion, wherein said female and male portions match to connect and anchor said protruding means within said retainer means.

8. A gas mask including a filter connection system of claim 1, wherein said mounting means is attached to said gas mask, wherein said retainer means holds said filter to said mounting means, wherein said protruding means engages said retainer means and shifts within said valving assembly to enable air to flow from said filter to said gas mask, and upon said retainer means releasing said filter from said protruding means, said mounting means is sealed from air flow.

9. The filter connection system of claim 1, wherein said valving assembly includes a cover that contains at least one inlet that upon engaging said retainer means, allows air to flow from said filter into said valving assembly.

10. The filter connection system of claim 9, wherein said retainer means contains a series of vents that match inlets on said cover to said valving assembly, such that when said protruding means engages said retainer means, air flows from said filter base through said vents and said inlets into said mounting means.

* * * * *